US005213924A

United States Patent [19]

Sakamoto

[11] Patent Number: 5,213,924

[45] Date of Patent: May 25, 1993

[54] ELECTROPHOTOGRAPHIC PHOTORECEPTOR CONTAINING POLYCARBONATE RESIN AS BINDER RESIN

[75] Inventor: Shuji Sakamoto, Sodegaura, Japan

[73] Assignee: Idemitsu Kosan Co. Ltd., Tokyo, Japan

[21] Appl. No.: 791,505

[22] Filed: Nov. 14, 1991

[30] Foreign Application Priority Data

Nov. 15, 1990 [JP] Japan ..... 2-307186

[51] Int. Cl.[5] ..... G03G 5/05

[52] U.S. Cl. ..... 430/58; 430/96

[58] Field of Search ..... 430/58, 69, 96

[56] References Cited

U.S. PATENT DOCUMENTS 3,925,074 12/1975 Wyhot ..... 430/69
4,637,971 1/1987 Takei et al. ..... 430/69
4,931,372 6/1990 Takei et al. ..... 430/69

FOREIGN PATENT DOCUMENTS 1153506 5/1969 United Kingdom .

OTHER PUBLICATIONS

Patent Abstracts of Japan, vol. 12, No. 46.
Patent Abstracts of Japan, vol. 13, No. 309.
Patent Abstracts of Japan, vol. 13, No. 351.
Patent Abstracts of Japan, vol. 12, No. 394.
Patent Abstracts of Japan, vol. 14, No. 111.

*Primary Examiner*—John Goodrow
*Attorney, Agent, or Firm*—Antonelli, Terry, Stout & Kraus

[57] ABSTRACT

Electrophotographic photoreceptors which are free of the whitening (gelation) of coating solutions during production thereof and maintain high mechanical strength, high surface hardness and excellent electrophotographic properties for a long period, are provided by using, as binder-resins in photosensitive layers, polycarbonate resins comprising the repeating unit represented by the following formula (I):

(I)

and the repeating unit represented by the following formula (II):

(II)

wherein X is the molar ratio of the repeating unit (I) to the total of the repeating units (I) and (II) being from 0.01 to 0.5, and the polycarbonate resin having a reduced viscosity of from 0.2 to 3.0 dl/g as measured in methylene chloride at a concentration of 0.5 g/dl at 20° C.

18 Claims, 1 Drawing Sheet

ELECTROPHOTOGRAPHIC PHOTORECEPTOR CONTAINING POLYCARBONATE RESIN AS BINDER RESIN

BACKGROUND OF THE INVENTION (a) Field of the Invention

The present invention relates to electrophotographic photoreceptors, more particularly, to electrophotographic photoreceptors which maintain high mechanical strength and excellent electrophotographic properties for a long period. The electrophotographic photoreceptors are useful in various fields of electrophotography.

(b) Description of the Related Art

In the fields of electrophotography, recently, there have been mainly used organic electrophotographic photoreceptors including layered-type electrophotographic photoreceptors and single-layer-type electrophotographic photoreceptors. The layered-type electrophotographic photoreceptors have a photosensitive layer comprising at least two elementary layers, that is, a charge generation layer where charges are generated by exposure, and a charge transport layer where transporting of the potential occurs. In the layered-type electrophotographic photoreceptors, the charge transport layer is composed of binder-resins and charge transporting materials dispersed or dissolved in the binder-resins. The single-layer-type electrophotographic photoreceptors have a photosensitive layer comprising one elementary layer where charge generating materials and charge transporting materials are dispersed or dissolved in binder-resins. Polycarbonate resins prepared from bisphenol A as a raw material have been widely used as the binder-resins both in the charge transport layers of layered-type electrophotographic photoreceptors and in the photosensitive layers of the single-layer-type electrophotographic photoreceptors.

Polycarbonate resins made from bisphenol A have such advantageous characteristics that they have relatively high mechanical strength and that they provide product photoreceptors with good electrical properties because of their good compatibility with charge transporting materials.

The use of polycarbonate resins made from bisphenol A for forming the charge transport layer of the photosensitive layer, however, encountered the following problems (1) and (2).

(1) In preparation of photoreceptors, whitening (gelation) of coating solutions for forming charge transport layers or photosensitive layers tends to occur or the formed charge transport layers or photosensitive layers tend to crystallize easily, depending on the solvents used for preparation of the coating solutions. This crystallization causes quality defects of developed images since photo-induced discharge hardly occurs on the crystallized regions of the charge transport layer, leaving residual charges which cause an undesirable electric potential on the regions.

(2) Charge transport layers or photosensitive layers formed by using polycarbonate resins made from bisphenol A have disadvantages that they tend to be peeled off from base layers owing to their poor adhesion to the base layers and that they are apt to be damaged or worn out owing to their poor surface hardness, resulting in their short lives in practical use for copying. Herein, the terms "base layer" mean the charge generation layer in general layered-type electrophotographic photoreceptors or the electroconductive substrate in single-layer-type electrophotographic photoreceptors. In case of positively-charged-type electrophotographic photoreceptors where a charge transport layer and a charge generation layer are successively laminated on an electroconductive substrate in that order, the terms "base layer", however, mean the electroconductive substrate. In case a blocking layer or an intermediate layer is interposed between an electroconductive substrate and a charge transport layer or a photosensitive layer or between a charge generating layer and a charge transport layer in order to improve electrophotographic properties, the terms "base layer" mean the blocking layer or the intermediate layer.

SUMMARY OF THE INVENTION

The object of the present invention is to solve the above-described problems which the conventional electrophotographic photoreceptors produced by using polycarbonate resins derived from bisphenol A as binder-resins have encountered, thereby providing electrophotographic photoreceptors which are excellent in practical use in that they are free of the whitening (gelation) of coating solutions during production thereof and maintain high mechanical strength, high surface hardness and excellent electrophotographic properties for a long period.

The inventor of the present invention conducted repeated research for solving the above-described problems, with the result that he found that electrophotographic photoreceptors wherein polycarbonate resins of specific structures were used as binder-resins in photosensitive layers, particularly, in charge transport layers of photosensitive layers were free from the problems that the conventional electrophotographic photoreceptors produced by using the polycarbonate resins derived from bisphenol A encountered. That is, he found that the use of such specific polycarbonate resins as binder-resins prevented coating solutions from whitening (gelation) during production of electrophotographic photoreceptors and that the obtained electrophotographic photoreceptors maintain high mechanical strength and excellent electrophotographic properties for a long period. The finding have led him to complete the present invention.

The present invention provides an electrophotographic photoreceptor which comprises an electroconductive substrate and a photosensitive layer disposed on a surface of the electroconductive substrate and is characterized in that the photosensitive layer contains a binder-resin comprising a polycarbonate resin having a repeating unit represented by the following formula (I):

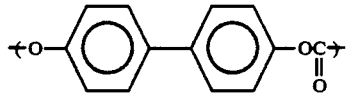

(I)

and a repeating unit represented by the following formula (II):

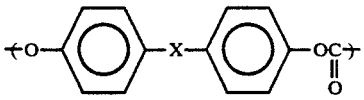

(II)

-continued wherein X is 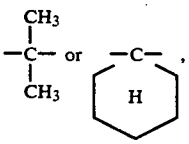

the repeating unit represented by the formula (I) being present in the polycarbonate resin in a molar ratio of the repeating unit represented by the formula (I) to the total of the repeating unit represented by the formula (I) and the repeating unit represented by the formula (II), (I)/{(I)+(II)}, of from 0.01 to 0.5, and the polycarbonate resin having a reduced viscosity [$\eta_{sp}$/c] of from 0.2 to 3.0 dl/g as measured in methylene chloride at a concentration of 0.5 g/dl at 20° C.

DESCRIPTION OF THE PREFERRED EMBODIMENTS

Figure 1:
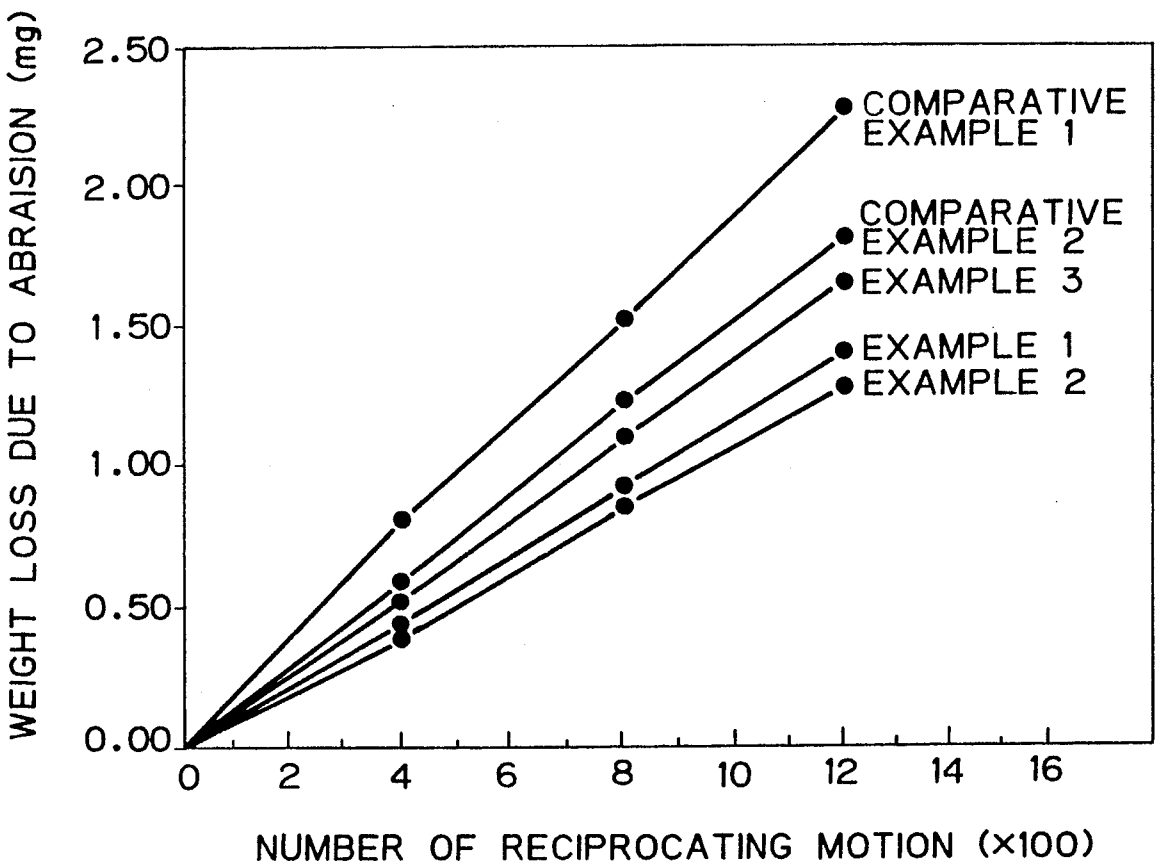
FIG. 1 is a graph showing the experimental results for testing the abrasion resistance of the charge transport layers of the electrophotographic photoreceptors produced in Examples and Comparative Examples.

The polycarbonate resin used in the electrophotographic photoreceptor of the present invention comprises the repeating unit represented by the formula (I) and the repeating unit represented by the formula (II), and the polycarbonate resin contains the repeating unit represented by the formula (I) in a molar ratio of the repeating unit represented by the formula (I) to the total of the repeating unit represented by the formula (I) and the repeating unit represented by the formula (II), (I)/{(I)+(II)}, of from 0.01 to 0.5.

If the molar ratio of the repeating unit represented by the formula (I) is less than 0.01, the effects of the present invention cannot be attained, and it will be impossible to prevent the whitening (gelation) of coating solutions and the crystallization of charge transport layers or photosensitive layers and to improve the life in practical use for copying. If the molar ratio is more than 0.5, the polycarbonate resin will partially crystallize and become unsuitable for the binder-resin of electrophotographic photoreceptors.

The preferred range of the molar ratio of the repeating unit represented by the formula (I) is from 0.05 to 0.5.

The biphenylene group in the repeating unit represented by the formula (I) may have one or more alkyl substituents of 1 to 6 carbon atoms on each benzene rings. That is, the repeating unit represented by the formula (I) may be replaced partially or wholly by a repeating unit represented by the following formula

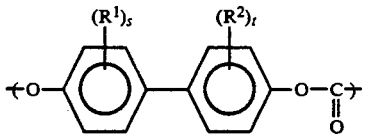

wherein $R^1$ and $R^2$ independently represent an alkyl group of 1 to 6 carbon atoms, and s and t independently represent an integer of 1 to 4.

The polycarbonate resin used in the present invention may contain other repeating units as far as they do not prevent achievement of the object of the present invention. The polycarbonate resin may further contain other polycarbonates and additives according to demand.

The polycarbonate resin used in the present invention has a reduced viscosity [$\eta_{sp}$/c] ranging from 0.2 to 3.0 dl/g as measured in methylene chloride at a concentration of 0.5 g/dl at 20° C. Polycarbonate resins having a reduced viscosity [$\eta_{sp}$/c] of less than 0.2 dl/g are disadvantageous in practical use. The reason is that such polycarbonate resins have poor mechanical strength, and, in particular, the surface hardness of the layers containing the polycarbonate resins as binder-resins have insufficient surface hardness whereby the lives of the photoreceptors are shortened by abrasion. If the reduced viscosity [$\eta_{sp}$/c] is more than 3.0 dl/g, the viscosity of polycarbonate resin solutions will be increased, causing difficulty in production of photoreceptors by a solution coating method.

The polycarbonate resin to be used in the present invention is prepared, for example, by a polycondensation of 4,4'-dihydroxybiphenyl represented by the following formula

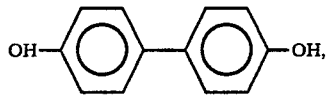

a dihydric phenol represented by the following formula (III)

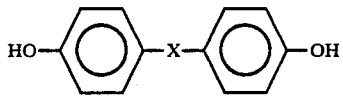

(III)

wherein X is as defined above, and a carbonate precursor in an appropriate solvent in the presence of an appropriate acid acceptor, or by a transesterification of a bisaryl carbonate with 4,4'-dihydroxybiphenyl and a dihydric phenol (III).

The biphenylene group of 4,4'-dihydroxybiphenyl may have one or more alkyl substituents of 1 to 6 carbon atoms on each benzene rings. That is, 4,4'-dihydroxybiphenyl may be replaced partially or wholly by a 4,4'-dihydroxybiphenyl compound represented by the following formula

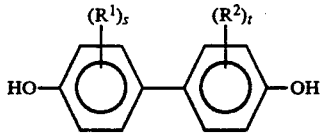

wherein $R^1$, $R^2$, s and t are as defined above.

Typical examples of 4,4'-dihydroxybiphenyl compounds which can be used include 4,4'-dihydroxy-3,3'-dimethylbiphenyl and 4,4'-dihydroxy-2,2'-dimethylbiphenyl.

Dihydric phenols represented by the formula (III) are 2,2-bis(4-hydroxyphenyl)propane represented by the following formula

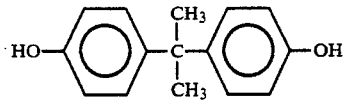

and 1,1-bis(4-hydroxyphenyl)cyclohexane represented by the following formula

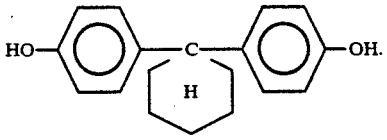

These dihydric phenols may be used individually or as a mixture thereof.

Typical examples of carbonate precursors which can be used in the polycondensation include carbonyl dihalides such as phosgene, haloformates such as chloroformate compounds, and carbonate compounds.

The ratio of the carbonate precursor to be used in the polycondensation may be determined in consideration of the stoichiometric ratio (equivalent) of the carbonate precursor in the polycondensation. When gaseous carbonate precursors, such as phosgene, are used, it is advantageous to bubble the gaseous carbonate precursors into the reaction system.

Typical examples of acid acceptors which can be used in the polycondensation include alkali metal hydroxides such as sodium hydroxide and potassium hydroxide, alkali metal carbonate such as sodium carbonate and potassium carbonate, organic bases such as pyridine, and mixtures thereof.

The ratio of the acid acceptor to be used in the polycondensation may also be determined in consideration of the stoichiometric ratio (equivalent) of the acid acceptor in the polycondensation, as described above. The preferred quantity of the acid acceptor is two equivalents or slightly more to the total number of moles of 4,4'-dihydroxybiphenyl and the dihydric phenol (III) used (generally, one mole corresponds to equivalent).

Solvents which can be used in the polycondensation are various solvents including those which are used in preparation of known polycarbonates, and they can be used individually or as a solvent mixture thereof. Typical examples of such solvents include hydrocarbon solvents such as xylene and halogenated hydrocarbon solvents such as methylene chloride and chlorobenzene. An interfacial polymerization may be carried out by using two kinds of solvents which are incompatible with each other.

It is preferable to carry out the polycondensation in the presence of catalysts which accelerate the polycondensation, for example, tertiary amines such as triethylamine and quarternary ammonium salts, and in the presence of molecular weight regulators which control polymerization degree, for example, p-tert-butylphenol and phenylphenols. Small quantities of antioxidants, for example, sodium sulfite and sodium hydrosulfite, also may be added to the polycondensation system, according to demand. The polycondensation is generally carried out at a temperature ranging from 0° to 150° C., preferably from 5° to 40° C. The polycondensation can be carried out under reduced pressure, at atmospheric pressure or under pressure, but generally, the polymerization proceeds readily at atmospheric pressure or under a spontaneous pressure of the reaction system. The period of the reaction varies depending on the reaction conditions employed, for example, the reaction temperature, but it is generally from 0.5 minutes to about 10 hours, preferably from one minute to two hours.

The polycondensation may also be carried out by a two-stage method wherein first some of the 4,4'-dihydroxybiphenyl and the dihydric phenol (III) to be used as raw materials and the whole carbonate precursor are allowed to react one another to form an oligomer, and then the remaining raw materials are added to complete the polycondensation. Such a two-stage method facilitates controlling the reaction, thereby permitting accurate control of molecular weight.

The transesterification of a bisaryl carbonate with 4,4'-dihydroxybiphenyl and a dihydric phenol (III) for the preparation of the polycarbonate resin to be used in the present invention is suitably carried out by a melt polycondensation technique or a solid phase polycondensation technique. In case of a melt polycondensation technique being employed, the above-described three kinds of monomers are mixed and are then allowed to react one another in a melted state under reduced pressure at high temperature. The reaction generally is carried out at a temperature ranging from 150° to 350° C., preferably from 200° to 300° C. In case of a solid phase polycondensation technique being employed, the above-described three kinds of monomers are mixed, and then a polycondensation is carried out, with the monomers remaining in solid state, by heating the mixture to a temperature not higher than the melting point of the formed polycarbonate resin. In either case, the reaction pressure is reduced finally to not higher than 1 mmHg, so that phenols derived from the bisaryl carbonate by the transesterification can be removed out from the reaction system. The period of the reaction varies depending on the reaction conditions employed, for example, the reaction temperature and the degree of the reduction of the pressure, but the reaction is carried out usually for about one to four hours. The reaction preferably is carried out under an atmosphere of an inert gas, such as nitrogen and argon. The reaction also may be carried out in the presence of the above-described molecular weight regulators and antioxidants, according to demand.

Adjustment of the reduced viscosity $[\eta_{sp}/c]$ of the resulting polycarbonate resin can be performed by various methods, for example, by selecting the above-described reaction conditions or by controlling the quantities of molecular weight regulators used, according to the desired reduced viscosity $[\eta_{sp}/c]$. It is also possible to obtain a polycarbonate resin having a desired reduced viscosity $[\eta_{sp}/c]$ by subjecting a polycarbonate resin prepared by a polycondensation or a transesterification to a proper physical treatment, for example, mixing or differential centrifugation, and/or a chemical treatment, for example, polymer reaction, crosslinking or partial decomposition.

The reaction product (crude product) thus obtained is subjected to various kinds of after treatments, including known separation and purification treatments, to collect a polycarbonate resin of a desired purity (degree of purification).

The electrophotographic photoreceptor of the present invention may have any structure, including the structure of any known electrophotographic photoreceptor, as far as it comprises an electroconductive substrate and a photosensitive layer deposited thereon and contains the above-described polycarbonate resin as a binder-resin in the photosensitive layer. Preferred examples of the electrophotographic photoreceptors according to the present invention are layered-type electrophotographic photoreceptors whose photosensitive layers contain at least one charge generation layer and at least one charge transport layer; and single-layer-type electrophotographic photoreceptors whose photosensitive layers comprise one elementary layer where both charge generating materials and charge transporting materials are dispersed or dissolved in a binder-resin.

In production of the layered-type electrophotographic photoreceptors of the present invention, the above-described polycarbonate resin can be used in any part of the photosensitive layer, but for the purpose of attaining maximum effects of the present invention, the polycarbonate resin is desirably used as a binder-resin of charge transporting materials in the charge transport layer. In case of the photosensitive layer containing two charge transport layers, it is preferable to use the polycarbonate resin in both the charge transport layers.

The polycarbonate resins to be used in the present invention as a binder resin may be used individually or as a mixture of two or more of them. Further, according to demand, other binder-resins, such as other polycarbonates, may be added to the polycarbonate resins of the present invention as far as they do not prevent achievement of the object of the present invention. Additives such as antioxidants may also be added.

In the electrophotographic photoreceptor of a layered-type according to the present invention that has a photosensitive layer comprising a charge generating layer and a charge transport layer, the charge transport layer may be disposed on the charge generating layer, or the charge generating layer may be disposed on the charge transport layer.

The photosensitive layer in the electrophotographic photoreceptor of the present invention may be covered by an electroconductive or insulating protecting film on its surface according to demand. Further, intermediate layers, for example, adhesive layers for improving adhesion between neighboring layers and blocking layers for blocking charges, may also be formed.

Electroconductive substrates which can be used in the present invention are of various kinds including known electroconductive substrates, and typical examples include sheets, plates or drums of metals, such as aluminum, brass, copper, nickel and steel, conductivity-introduced substrates obtained by depositing, spattering or applying a conductive material, such as aluminum, nickel chromium, palladium and graphite, on a plastics sheet, and other conductivity-introduced substrates obtained by giving a treatment for introducing electric conductivity to a glass plate, a plastics plate, cloth or paper.

The photosensitive layer in the single-layer-type electrophotographic photoreceptor of the present invention can be suitably formed by dispersing or dissolving both a charge generating material and a charge transporting material together with the above-described polycarbonate resin in a solvent to prepare a coating liquid, applying the coating liquid on an electroconductive substrate, and then drying. The polycarbonate resins may be used individually or as a mixture of two or more of them. Further, the polycarbonate resins may be used together with other binder-resins and additives, such as antioxidants, as far as the achievement of the object of the present invention is not prevented.

The charge generating layer in the layered-type electrophotographic photoreceptor of the present invention contains at least a charge generating material. The charge generating layer can be provided by forming a layer of a charge generating material on a base layer, for example, an electroconductive substrate or a charge transport layer, using, for example, a vacuum deposition technique or a spattering technique, or by making a charge generating material adhere to the base layer using a binder-resin. Various known methods may be employed for forming the charge generating layer using a binder-resin. It is generally suitable for forming the charge generating layer by dispersing or dissolving a charge generating material together with a binder-resin in a solvent to prepare a coating liquid, applying the coating liquid on a base layer and then drying.

Binder-resins which can be used in the charge generating layer are various ones, including known binder-resins. Typical examples include thermoplastic resins, such as polystyrene, polyvinyl chloride, polyvinyl acetate, vinyl chloride-vinyl acetate copolymer, polyvinyl acetal, alkyd resins, acrylic resins, polyacrylonitrile, polycarbonates, polyamides, polyketones, polyacrylamides, polybutyral resins and polyesters, and thermosetting resins, such as polyurethanes, epoxy resins and phenol resins.

The polycarbonate resins of the present invention also may be used as binder-resins in the charge generating layer.

The charge transport layer in the electrophotographic photoreceptor can be provided by making a charge transporting material adhere to a base layer, for example, a charge generating layer or an electroconductive substrate, using a binder-resin. Various known methods may be employed for forming the charge transport layer. It is generally suitable for forming the charge transport layer by dispersing or dissolving a charge transporting material together with the above-described polycarbonate resin in a solvent to prepare a coating liquid, applying the coating liquid on a base layer, for example, an electroconductive substrate or a charge transport layer, and then drying. The polycarbonate resins may be used individually or as a mixture of two or more of them. Further, the polycarbonate resins may be used together with other binder-resins as far as achievement of the object of the present invention is not prevented.

Charge generating materials which can be used in the electrophotographic photoreceptor of the present invention are various ones including known charge generating materials. Typical examples of the charge generating materials are simple substances of selenium, such as non-crystalline selenium and crystalline selenium of a trigonal system, selenium-based alloys, such as selenium-tellurium alloy, selenides, such as $As_2Se_3$, selenium-containing compositions, zinc oxide, inorganic materials comprising an element of the group II and that of the group IV in the periodic table, such as CdS-Se, and oxide semiconductors, such as titanium oxide, silicon-based materials, such as metal-free amorphous silicon, and various organic materials, such as phthalocyanine, metal complexes of phthalocyanine, cyanine, anthracene, pyrene, perylene, pyrylium salts, thiapyrylium salts, polyvinyl carbazole, azo pigments, bisazo pigments and squarelium pigments.

These charge generating materials may be used individually or as a mixture of two or more of them.

Charge transporting materials which can be used in the electrophotographic photoreceptor of the present invention are, for example, electron transporting materials and positive hole transporting materials, which have been conventionally used.

Typical examples of the electron transporting materials include electron withdrawing compounds, such as chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone and 2,4,9-trinitrothioxanthone, 3,5-dimethyl-3',5'-di-tert-butyl-4,4'-diphenoquinone and high molecular materials prepared from them. These may be used individually or as a mixture of two or more of them.

Typical examples of the positive hole transporting materials include pyrenes, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, hydrazones, such as p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone and 1-phenyl-1,2,3,4-tetrahydroquinoline-6-carboxyaldehyde-1',1'-diphenylhydrazone, pyrazolines, such as 2,5-bis(p-diethylaminophenyl)-1,3,4-oxadiazole, 1-phenyl-3-(p-diethylaminostyryl)-5-(p-diethylaminophenyl)pyrazoline, 1-[quinoryl(2)]-3-(p-diethylaminostyryl)-5-(-diethylaminophenyl)pyrazoline, 1-[lepidyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)pyrazoline, 1-[pyridyl(5)]-3-(p-diethylaminophenyl)pyrazoline, 1-[pyridyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline and spiropyrazoline, oxazole compounds, such as 2-(p-diethylaminostyryl)-δ-diethylaminobenzoxazole and 2-(p-diethylaminophenyl)-4-(p-dimethylaminophenyl)-5-(2-chlorophenyl-)oxazole, thiazole compounds, such as 2-(p-diethylaminostyryl)-6-diethylaminobenzthiazole, triarylmethane derivatives, such as bis(4-diethylamino-2-methylphenyl)-phenylmethane, (polyaryl)amines, such as 1,1-bis(4-N,N-diethylamino-2-methylphenyl)heptane and 1,1,2,2-tetrakis(4-N,N-dimethylamino-2-methylphenyl)ethane, benzidine compounds, such as N,N'-diphenyl-N,N'-bis(methylphenyl)benzidine, N,N'-diphenyl-N,N'-bis(ethylphenyl)benzidine, N,N'-diphenyl-N,N'-bis(propylphenyl)benzidine, N,N'-diphenyl-N,N'-bis(butylphenyl)benzidine, N,N'-diphenyl-N,N'-bis(isopropylphenyl)benzidine, N,N'-diphenyl-N,N'-bis(sec-butylphenyl)benzidine, N,N'-diphenyl-N,N'-bis(tert-butylphenyl)benzidine and N,N'-diphenyl-N,N'-bis(chlorophenyl)benzidine, triphenylamine, butadiene compounds, such as 1,1-bis(p-diethylaminophenyl)-4,4-diphenyl-1,3-butadiene, poly(N-vinyl carbazole, poly(vinylpyrene), poly(vinylanthracene), poly(vinylacridine), poly(9-vinylphenylanthracene), organopolysilanes, pyrene-formaldehyde resins and ethylcarbazole-formaldehyde resins.

These positive hole transporting materials may be used individually or as a mixture of two or more of them.

Solvents which can be used for preparation of the coating liquids for forming the above-described charge generating layer, charge transport layer or photosensitive layer are, for example, aromatic solvents, such as benzene, toluene, xylenes and chlorobenzene, ketones, such as acetone, methyl ethyl ketone and cyclohexanone, alcohols, such as methanol, ethanol and isopropyl alcohol, esters, such as ethyl acetate and ethyl cellosolves, halogenated hydrocarbons, such as tetrachloromethane, tetrabromomethane, chloroform, dichloromethane and tetrachloroethane, ethers, such as tetrahydrofuran and dioxane, dimethylformamide, dimethylsulfoxide and diethylformamide.

These solvents may be used individually or in a form of a solvent mixture of two or more of them.

In preparation of the electrophotographic photoreceptor of the present invention, the applications of the coating liquids in forming the respective layers may be performed by using a variety of application devices, including known ones. Application devices which can be used are, for example, applicators, spray coaters, bar coaters, roll coaters, dip coaters and doctor blade.

The electrophotographic photoreceptor of the present invention is very excellent in practical use, since it is free of whitening (gelation) of coating liquids during production thereof and maintains high mechanical strength and excellent electrophotographic properties even if it is used repeatedly for a long period. It, therefore, is useful in various fields of electrophotography.

The present invention will be described in more detail with reference to the following Examples. These Examples, however, are not to be construed to limit the scope of the invention.

EXAMPLES 1 TO 4 AND COMPARATIVE EXAMPLES 1 AND 2

In the following Examples and Comparative Examples, evaluations of the electrophotographic properties of the obtained electrophotographic photoreceptors were conducted by using a static charging testing device produced by Kawaguchi Denki Seisaku-sho Co., Ltd. After performing a corona electrical charging at −6 kV, the initial surface potential ($V_o$), the residual potential ($V_R$) after light irradiation of 10 Lux, the half decay exposure ($E_{\frac{1}{2}}$) were measured.

EXAMPLE 1

A solution of 74 g of 2,2-bis-(4-hydroxyphenyl)propane dissolved in 550 ml of a 6% concentration aqueous sodium hydroxide solution was mixed with 250 ml of methylene chloride, and gaseous phosgene was bubbled into the mixture for 15 minutes at a feed rate of 950 ml/min while the mixture was cooled and stirred. Subsequently, the resulting reaction solution was allowed to stand and separate, to obtain an organic phase which was a methylene chloride solution of an oligomer of a polymerization degree of 2 to 4 having chloroformate groups at main chain ends.

Methylene chloride was added to the obtained solution of the oligomer to obtain 450 ml of a solution of the oligomer, the solution of the oligomer was then mixed with a solution of 24 g of 4,4' -dihydroxybiphenyl dissolved in 150 ml of a 8% concentration aqueous sodium hydroxide solution, and 3.0 g of p-tert-butylphenol was added thereto as a molecular weight regulator. While the mixed solution was stirred vigorously, 2 ml of a 7% concentration aqueous triethylamine solution was added, and reaction was carried out at 28° C. for 1.5 hours with stirring.

After completion of the reaction, the resulting reaction product was diluted with one liter of methylene chloride and was then washed twice with two portions of 1.5 liter of water, once with one liter of 0.01-N hydrochloric acid and twice with two portions of one liter of water, in this order. Subsequently, organic phase was added in methanol to carry out a purification by reprecipitation.

The polymer thus obtained had a reduced viscosity of 0.82 dl/g as measured in methylene chloride at a concentration of 0.5 g/dl at 20° C.

An $^1$H-NMR spectrum analysis of the obtained polymer showed that the polymer was a polycarbonate comprising the following repeating units and composition.

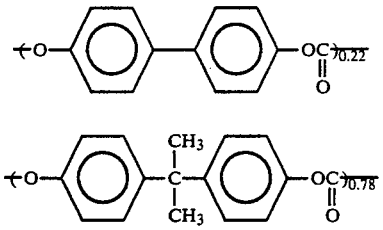

A tetrahydrofuran solution containing 10% by weight of the polycarbonate and 50% by weight of the following hydrazone compound as a charge transporting material was prepared to obtain a coating liquid for forming a charge transport layer. The coating liquid was allowed to stand for one month, but neither whitening nor gelation of the coating liquid occurred.

Charge Transforming Material
(1-phenyl-1,2,3,4-tetrahydroquinoline-6-carboxyaldehyde-1',1'-diphenylhydrazone

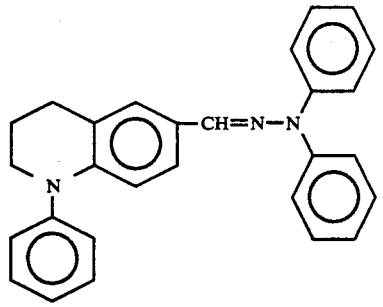

A layered-type electrophotographic photoreceptor was produced by applying the coating liquid on a charge generating layer of about 0.5 μm thickness which had been formed on a surface of an electroconductive substrate made of aluminum, followed by drying to form a charge transport layer of 20 μm thickness. No crystallization of the charge transport layer was found in this application course.

The electrophotographic properties of the obtained electrophotographic photoreceptor, namely, the initial surface potential ($V_o$) after corona electrical charging at −6 kV, the residual potential ($V_R$) after light irradiation of 10 Lux and the half decay exposure ($E_{\frac{1}{2}}$) were measured. The results are shown in Table 1. Evaluation of the abrasion resistance of the charge transport layer was performed by an abrasion test using an abrasion testing machine. In the abrasion test, a sample of the electrophotographic photoreceptor was put into a certain number of reciprocating motion on an abrasive paper applied with a load of 200 g, with the surface of the charge transport layer being contact with the abrasive paper, and the change of the weight loss of the charge transport layer due to abrasion was measured. The results are shown in FIG. 1.

EXAMPLE 2

The procedure of Example 1 was repeated with the exception that 87 g of 1,1-bis(4-hydroxyphenyl)cyclohexane was used in place of 74 g of 2,2-bis(4-hydroxyphenyl)propane used in Example 1, to obtain a polycarbonate comprising the following repeating units and composition ([$\eta_{sp}$/c]=0.89 dl/g).

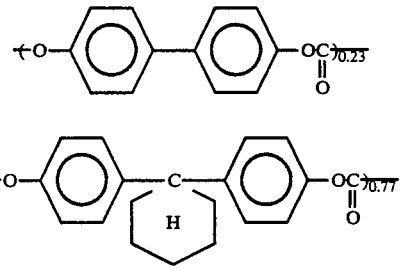

A layered-type electrophotographic photoreceptor was produced in the same manner as in Example 1 with the exception that the polycarbonate thus obtained was used as a binder-resin for a charge transporting material. The results of evaluations of the stability of the coating liquid prepared in this Example and the crystallization in the application course were both similar to those of Example 1. The results of evaluations of the electrophotographic properties of the electrophotographic photoreceptor and the abrasion resistance of the charge transport layer are shown in Table 1 and FIG. 1, respectively.

EXAMPLE 3

The procedure of Example 1 was repeated with the exception that 15 g of 2,2-bis(4-hydroxyphenyl)propane was used in place of 24 g of 4,4'-dihydroxybiphenyl used in Example 1, to obtain a polycarbonate comprising the following repeating units and composition ([$\eta_{sp}$/c]=0.77 dl/g).

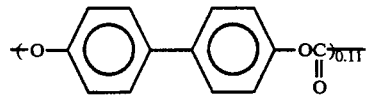

-continued

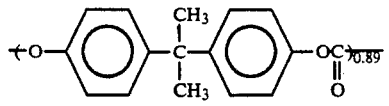

A layered-type electrophotographic photoreceptor was produced in the same manner as in Example 1 with the exception that the polycarbonate thus obtained was used as a binder-resin for the charge transporting material. The results of evaluations of the stability of the coating liquid prepared in this Example and the crystallization in the application course were both similar to those of Example 1. The results of evaluations of the electrophotographic properties of the electrophotographic photoreceptor and the abrasion resistance of the charge transport layer are shown in Table 1 and FIG. 1, respectively.

COMPARATIVE EXAMPLE 1

A layered-type electrophotographic photoreceptor was prepared in the same manner as in Example with the exception that a commercial polycarbonate ($[\eta_{sp}/c]=0.78$ dl/g) prepared by using 2,2-bis(4-hydroxyphenyl)propane (bisphenol A) as a monomer was used as a binder-resin for the charge transporting material. The coating liquid prepared for forming an charge transport layer was whitened with the occurrence of its gelation two days after its preparation. In addition, at the time of application of the coating liquid, crystallization (whitening) of some parts of the formed charge transport layer was observed. The results of evaluations of the electrophotographic properties of the electrophotographic photoreceptor and the abrasion resistance of the charge transport layer are shown in Table 1 and FIG. 1, respectively.

COMPARATIVE EXAMPLE 2

The procedure of Example 1 was repeated with the exception that 87 g of 1,1-bis(4-hydroxyphenyl)cyclohexane was used in place of 74 g of 2,2-bis(4-hydroxyphenyl)propane used in Example 1, and 35 g of 1,1-bis(4-hydroxyphenyl)cyclohexane was used in place of 24 g of 4,4'-dihydroxybiphenyl used in Example 1, to obtain a polycarbonate comprising the following repeating units and composition ($[\eta_{sp}/c]=0.84$ dl/g).

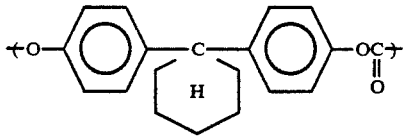

A layered-type electrophotographic photoreceptor was produced in the same manner as in Example 1 with the exception that the polycarbonate thus obtained was used as a binder-resin for the charge transporting material. The results of evaluations of the stability of the coating liquid prepared in this Example and the crystallization in the application course were both similar to those of Example 1. The results of evaluations of the electrophotographic properties of the electrophotographic photoreceptor and the abrasion resistance of the charge transport layer are shown in Table 1 and FIG. 1, respectively.

TABLE 1

| | Initial surface potential $V_O$ (V) | Residual potential $V_R$ (V) | Half decay exposure $E_{\frac{1}{2}}$ (Lux.sec) |
|---|---|---|---|
| Example 1 | −730 | −1 | 0.78 |
| Example 2 | −742 | −2 | 0.81 |
| Example 3 | −724 | −2 | 0.79 |
| Comparative Example 1 | −752 | −3 | 0.84 |
| Comparative Example 2 | −732 | −4 | 0.85 |

EXAMPLE 4

A coating liquid was prepared by dissolving 1 g of the polycarbonate obtained in Example 1, 0.1 of oxotitanium phthalocyanine as a charge generating material and 1 g of the hydrazone compound used in Example 1 in 8 ml of tetrahydrofuran. The coating liquid was allowed to stand for one month, but neither whitening nor gelation of the coating liquid occurred.

A single-layer-type electrophotographic photoreceptor was produced by applying the coating liquid on an electroconductive substrate made of aluminum, followed by drying to form a photosensitive layer of 20 μm thickness. When the electrophotographic photoreceptor was put to the abrasion test employed in Example 1, the weight loss of the photosensitive layer due to abrasion was 1.64 mg after 1200 reciprocating motion. The adhesion property between the photosensitive layer and the electroconductive substrate was evaluated by employing a peeling test with a Scotch tape. The adhesion property of the photosensitive layer was so good that more than 80% of samples retained the adhesion between the photosensitive layer and the electroconductive substrate.

What is claimed is:

1. An electrophotographic photoreceptor comprising an electroconductive substrate and a photosensitive layer disposed on a surface of the electroconductive substrate, the photosensitive layer containing a binder resin that comprises a polycarbonate resin having the repeating unit represented by the following formula (I):

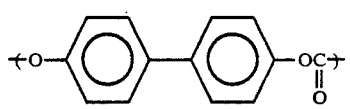

(I)

and the repeating unit represented by the following formula (II):

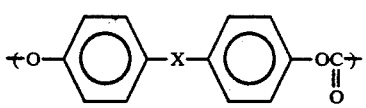

(II)

wherein X is 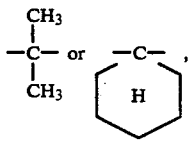 or , the repeating unit represented by the formula (I) being present in the polycarbonate resin in a molar ratio of the repeating unit represented by the formula (I) to the total of the repeating unit represented by the formula (I) and the repeating unit represented by the formula (II), (I)/{(I)+(II)}, of from 0.01 to 0.5, and the polycarbonate resin having a reduced viscosity [$\eta_{sp}/c$] of from 0.2 to 3.0 dl/g as measured in methylene chloride at a concentration of 0.5 g/dl at 20° C.

2. The electrophotographic photoreceptor as claimed in claim 1, wherein the repeating unit represented by the formula (I) being present in the polycarbonate resin in a molar ratio of the repeating unit represented by the formula (I) to the total of the repeating unit represented by the formula (I) and the repeating unit represented by the formula (II), (I)/{(I)+(II)}, of from 0.05 to 0.5.

3. The electrophotographic photoreceptor as claimed in claim 1, wherein the photosensitive layer consists of one layer which comprises a charge generating material, a charge transporting material and binder-resin comprising the polycarbonate resin.

4. The electrophotographic photoreceptor as claimed in claim 3, wherein the repeating unit represented by the formula (I) is present in the polycarbonate resin in a molar ratio of the repeating unit represented by the formula (I) to the total of the repeating unit represented by the formula (I) and the repeating unit represented by the formula (II), (I)/{(I)+(II)}, of from 0.05 to 0.5.

5. The electrophotographic photoreceptor as claimed in claim 4, wherein the charge generating material is selected from the group consisting of a single substance of selenium, a selenium alloy, a selenide, a selenium-containing composition, zinc oxide, an inorganic material comprising an element of the group II and an element of the group IV in the periodic table, an oxide semiconductor, a silicon material, metal-free phthalocyanine, a metal complex of phthalocyanine, cyanine, anthracene, pyrene, perylene, a pyrylium salt, a thiapyrylium salt, polyvinyl carbazole, an azo pigment, a bisazo pigment and a squarelium pigment, and the charge transporting material is selected from the group consisting of an electron transporting material and a positive hole transporting material.

6. The electrophotographic photoreceptor as claimed in claim 4, wherein the charge generating material is selected from the group consisting of non-crystalline selenium, crystalline selenium of a trigonal system, selenium-tellurium alloy, $As_2Se_3$, zinc oxide, CdS-Se, titanium oxide, amorphous silicon, metal-free phthalocyanine, oxotitanium phthalocyanine, cyanine, anthracene, pyrene, perylene, a pyrylium salt, a thiapyrylium salt, polyvinyl carbazole, an azo pigment, a bisazo pigment and a squarelium pigment, and the charge transporting material is selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone and 2,4,9-trinitrothioxanthone, 3,5-dimethyl-3',5'-di-tert-butyl-4,4'-diphenoquinone, a high molecular material prepared therefrom, pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, 1-phenyl-1,2,3,4-tetrahydroquinoline-6-carboxyaldehyde-1',1'-diphenylhydrazone, 2,5-bis(p-diethylaminophenyl)-1,3,4-oxadiazole, 1-phenyl-3-(p-diethylaminostyryl)-5-(p-diethylaminophenyl)pyrazoline, 1-[quinoryl(2)]-3-(p-diethylaminostyryl)-5-(-diethylaminophenyl)pyrazoline, 1-[lepidyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)pyrazoline, 1-[pyridyl(5)]-3-(p-diethylaminophenyl)pyrazoline, 1-[pyridyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, 2-(p-diethylaminostyryl)-δ-diethylaminobenzoxazole, 2-(p-diethylaminophenyl)-4-(p-dimethylaminophenyl)-5-(2-chlorophenyl)oxazole, 2-(p-diethylaminostyryl)-6-diethylaminobenzthiazole, bis(4-diethylamino-2-methylphenyl)-phenylmethane, 1,1-bis(4-N,N-diethylamino-2-methylphenyl)heptane, 1,1,2,2-tetrakis(4-N,N-dimethylamino-2-methylphenyl)ethane, N,N'-diphenyl-N,N'-bis(methylphenyl)benzidine, N,N'-diphenyl-N,N'-bis(ethylphenyl)benzidine, N,N'-diphenyl-N,N'-bis(-propylphenyl)benzidine, N,N'-diphenyl-N,N'-bis(butylphenyl)benzidine, N,N'-diphenyl-N,N'-bis(isopropylphenyl)benzidine, N,N'-diphenyl-N,N'-bis(sec-butylphenyl)benzidine, N,N'-diphenyl-N,N'-bis(tert-butylphenyl)benzidine, N,N'-diphenyl-N,N'-bis(chlorophenyl)benzidine, triphenylamine, 1,1-bis(p-diethylaminophenyl)-4,4-diphenyl-1,3-butadiene, poly(N-vinyl carbazole, poly(vinylpyrene), poly(vinylanthracene), poly(vinylacridine), poly(9-vinylphenylanthracene), an organopolysilane, pyrene-formaldehyde resin and ethylcarbazole-formaldehyde resin.

7. The electrophotographic photoreceptor as claimed in claim 5, wherein the repeating unit represented by the formula (II) is a repeating unit represented by the following formula

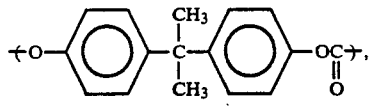

the charge generating material is oxotitanium phthalocyanine, and the charge transporting material is 1-phenyl-1,2,3,4-tetrahydroquinoline-6-carboxyaldehyde-1',1'-diphenylhydrazone.

8. The electrophotographic photoreceptor as claimed in claim 6, wherein the repeating unit represented by the formula (II) is a repeating unit represented by the following formula

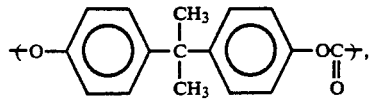

the charge generating material is oxotitanium phthalocyanine, and the charge transporting material is 1-phenyl-1,2,3,4-tetrahydroquinoline-6-carboxyaldehyde-1',1'-diphenylhydrazone.

9. The electrophotographic photoreceptor as claimed in claim 1, wherein the photosensitive layer comprises a charge generating layer and a charge transport layer, the charge generating layer comprising a charge generating material, and charge transport layer comprising a charge transporting material and the binder-resin that comprises the polycarbonate resin.

10. The electrophotographic photoreceptor as claimed in claim 9, wherein the repeating unit represented by the formula (I) is present in the polycarbonate resin in a molar ratio of the repeating unit represented by the formula (I) to the total of the repeating unit represented by the formula (I) and the repeating unit represented by the formula (II), (I)/{(I)+(II)}, of from 0.05 to 0.5.

11. The electrophotographic photoreceptor as claimed in claim 10, wherein the charge generating material is selected from the group consisting of a single substance of selenium, a selenium alloy, a selenide, a selenium-containing composition, zinc oxide, an inorganic material comprising an element of the group II and an element of the group IV in the periodic table, an oxide semiconductor, a silicon material, metal-free phthalocyanine, a metal complex of phthalocyanine, cyanine, anthracene, pyrene, perylene, a pyrylium salt, a thiapyrylium salt, polyvinyl carbazole, an azo pigment, a bisazo pigment and a squarelium pigment, and the charge transporting material is selected from the group consisting of an electron transporting material and a positive hole transporting material.

12. The electrophotographic photoreceptor as claimed in claim 10, wherein the charge generating material is selected from the group consisting of non-crystalline selenium, crystalline selenium of a trigonal system, selenium-tellurium alloy, $As_2Se_3$, zinc oxide, CdS-Se, titanium oxide, amorphous silicon, metal-free phthalocyanine, oxotitanium phthalocyanine, cyanine, anthracene, pyrene, perylene, a pyrylium salt, a thiapyrylium salt, polyvinyl carbazole, an azo pigment, a bisazo pigment and a squarelium pigment, and the charge transporting material is selected from the group consisting of chloranil, bromanil, tetracyanoethylene, tetracyanoquinodimethane, 2,4,7-trinitro-9-fluorenone, 2,4,5,7-tetranitro-9-fluorenone, 2,4,7-trinitro-9-dicyanomethylenefluorenone, 2,4,5,7-tetranitroxanthone and 2,4,9-trinitrothioxanthone, 3,5-dimethyl-3',5'-di-tert-butyl-4,4'-diphenoquinone a high molecular material prepared therefrom, pyrene, N-ethylcarbazole, N-isopropylcarbazole, N-methyl-N-phenylhydrazino-3-methylidene-9-ethylcarbazole, N,N-diphenylhydrazino-3-methylidene-9-ethylcarbazole, N,N-diphenylhydrazino-3-methylidene-10-ethylphenothiazine, N,N-diphenylhydrazino-3-methylidene-10-ethylphenoxazine, p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone-2-hydrazone, 1-phenyl-1,2,3,4-tetrahydroquinoline-6-carboxyaldehyde-1',1'-diphenylhydrazone, 2,5-bis(p-diethylaminophenyl)-1,3,4-oxadiazole, 1-phenyl-3-(p-diethylaminostyryl)-5-(p-diethylaminophenyl)pyrazoline, 1-[quinoryl(2)]-3-(p-diethylaminostyryl)-5-(-diethylaminophenyl)pyrazoline, 1-[lepidyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)pyrazoline, 1-[pyridyl(5)]-3-(p-diethylaminophenyl)pyrazoline, 1-[pyridyl(2)]-3-(p-diethylaminostyryl)-5-(p-diethylaminophenyl)pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, 2-(p-diethylaminostyryl)-δ-diethylaminobenzoxazole, 2-(p-diethylaminophenyl)-4-(p-dimethylaminophenyl)-5-(2-chlorophenyl)oxazole, 2-(p-diethylaminostyryl)-6-diethylaminobenzthiazole, bis(4-diethylamino-2-methylphenyl)-phenylmethane, 1,1-bis(4-N,N-diethylamino-2-methylphenyl)heptane, 1,1,2,2-tetrakis(4-N,N-dimethylamino-2-methylphenyl)ethane, N,N'-diphenyl-N,N'-bis(methylphenyl)benzidine, N,N'-diphenyl-N,N'-bis(ethylphenyl)benzidine, N,N'-diphenyl-N,N'-bis(-propylphenyl)benzidine, N,N'-diphenyl-N,N'-bis(butylphenyl)benzidine, N,N'-diphenyl-N,N'-bis(isopropylphenyl)benzidine, N,N'-diphenyl-N,N'-bis(sec-butylphenyl)benzidine, N,N'-diphenyl-N,N'-bis(tert-butylphenyl)benzidine, N,N'-diphenyl-N,N'-bis(chlorophenyl)benzidine, triphenylamine, 1,1-bis(p-diethylaminophenyl)-4,4-diphenyl-1,3-butadiene, poly(N-vinyl carbazole, poly(vinylpyrene), poly(vinylanthracene), poly(vinylacridine), poly(9-vinylphenylanthracene), an organopolysilane, pyrene-formaldehyde resin and ethylcarbazole-formaldehyde resin.

13. The electrophotographic photoreceptor as claimed in claim 11, wherein the charge generating layer is disposed between the electroconductive layer and the charge transport layer.

14. The electrophotographic photoreceptor as claimed in claim 12, wherein the charge generating layer is disposed between the electroconductive layer and the charge transport layer.

15. The electrophotographic photoreceptor as claimed in claim 13, wherein the repeating unit represented by the formula (II) is a repeating unit represented by the following formula

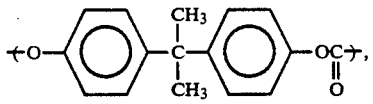

the charge generating material is oxotitanium phthalocyanine, and the charge transporting material is 1-phenyl-1,2,3,4-tetrahydroquinoline-6-carboxyaldehyde-1',1'-diphenylhydrazone.

16. The electrophotographic photoreceptor as claimed in claim 14, wherein the repeating unit represented by the formula (II) is a repeating unit represented by the following formula

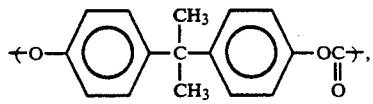

the charge generating material is oxotitanium phthalocyanine, and the charge transporting material is 1-phenyl-1,2,3,4-tetrahydroquinoline-6-carboxyaldehyde-1',1'-diphenylhydrazone.

17. The electrophotographic photoreceptor as claimed in claim 13, wherein the repeating unit represented by the formula (II) is a repeating unit represented by the following formula

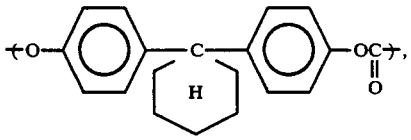

the charge generating material is oxotitanium phthalocyanine, and the charge transporting material is 1-phenyl-1,2,3,4-tetrahydroquinoline-6-carboxyaldehyde-1',1'-diphenylhydrazone.

18. The electrophotographic photoreceptor as claimed in claim 14, wherein the repeating unit represented by the formula (II) is a repeating unit represented by the following formula

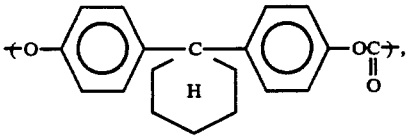

the charge generating material is oxotitanium phthalocyanine, and the charge transporting material is 1-phenyl-1,2,3,4-tetrahydroquinoline-6-carboxyaldehyde-1',1'-diphenylhydrazone.

* * * * *